United States Patent [19]

Rawl

[11] Patent Number: 4,848,929

[45] Date of Patent: Jul. 18, 1989

[54] VOLATILE EMITTING CONTAINER

[75] Inventor: Henry J. Rawl, Savannah, Ga.

[73] Assignee: Union Camp Corporation, Wayne, N.J.

[21] Appl. No.: 672,692

[22] Filed: Nov. 19, 1984

[51] Int. Cl.[4] ..... B65D 27/14

[52] U.S. Cl. ..... 383/85; 239/55; 428/905

[58] Field of Search ..... 428/905; 206/205; 383/85, 86; 239/55

[56] References Cited

U.S. PATENT DOCUMENTS

| | | | |
|---|---|---|---|
| 2,215,989 | 9/1940 | Wolf | 383/86 |
| 2,774,531 | 12/1956 | Rosenthal | 428/905 |
| 3,557,853 | 1/1971 | Jones | 383/86 |
| 3,599,859 | 8/1971 | Maierson | 429/905 |
| 3,685,734 | 8/1972 | Paciorek et al. | 428/905 |
| 3,711,024 | 1/1973 | Hammond | 239/55 |
| 4,186,743 | 2/1980 | Steiger | 428/905 |
| 4,349,104 | 9/1982 | Hayes | 206/205 |
| 4,487,801 | 12/1984 | Turnbull et al. | 428/905 |
| 4,493,869 | 1/1985 | Sweeny et al. | 428/905 |

*Primary Examiner*—Stephen P. Garbe
*Attorney, Agent, or Firm*—Edward J. Sites

[57] ABSTRACT

Containers are disclosed which include an adhesive composition sealing a component part. The adhesive contains a volatile, environment affecting compound for slow release to the atmosphere.

4 Claims, 1 Drawing Sheet

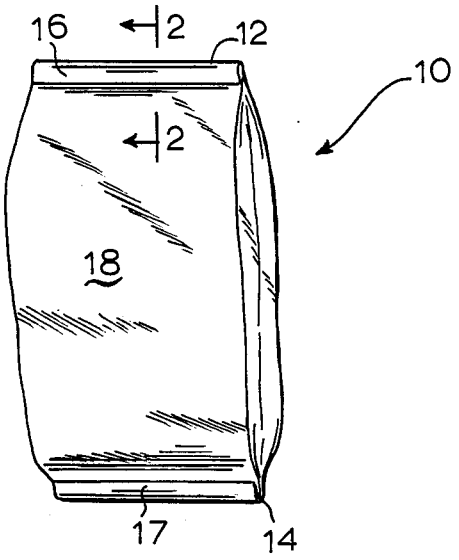
FIG.1
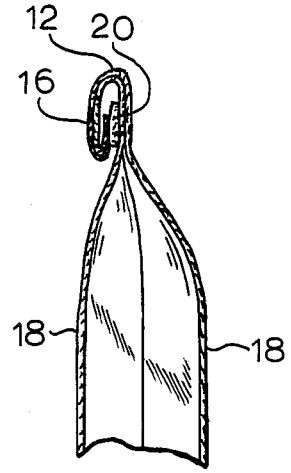
FIG.2
C13 FIG.3
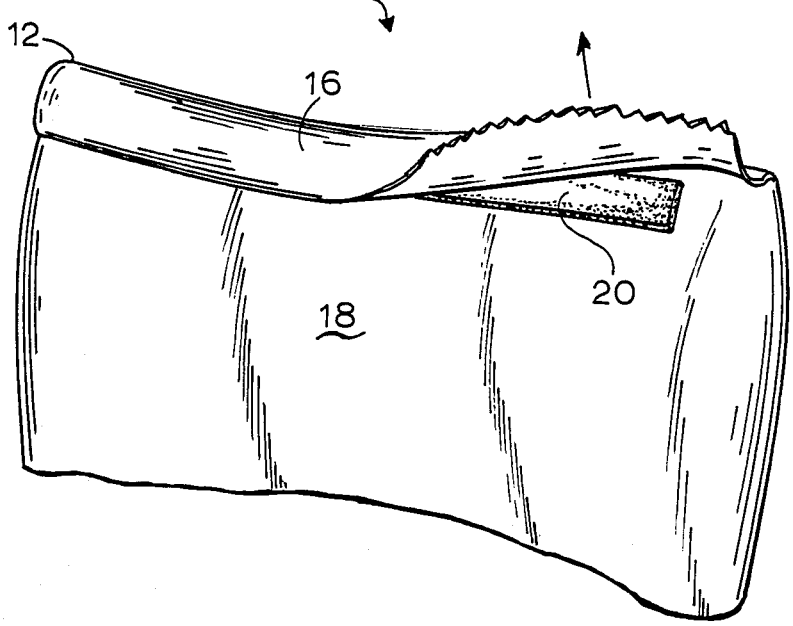

VOLATILE EMITTING CONTAINER

BACKGROUND OF THE INVENTION

1. Field of the Invention

The invention relates to containers and methods for slowly sustained release of volatiles such as fragrant odors, therefrom.

2. Brief Description of the Prior Art

A wide variety of containers have been used to package materials, including materials which have no odor, have latent potential pleasant odors, or are judged to possess offensive odors. For example, bag type containers have been used to package pet foods, absorbent litter materials and the like which have natural or built in desirable latent odors or which may in some cases possess objectionable odor characteristics. Once opened, these packaged materials may either have no initial odor or perfuse the local atmosphere with the objectionable odor.

By the present invention, containers for non-odorous materials and for objectional odor releasing materials are provided, wherein the plies are combined or sealed closed with a fragrance-containing adhesive composition. There is a low release of fragrance odor before opening and upon opening the adhesive seal is disturbed, greatly increasing the fragrance released to the local atmosphere so as to enhance the appeal of a non odorous material, to simulate the latent odor of packaged material or mask or counteract the offensive odor of the materials in the opened container.

The containers of the invention are not limited to the inclusion of fragrances as the volatile agent released, but may include agents protective of the environment or container contents, such as insecticides, fungicides and the like.

SUMMARY OF THE INVENTION

In a container formed by the adhesive sealing of a component part, the improvement which comprises; the presense of a volatile, sustained release, environment affecting agent;

said adhesive composition containing and slowly releasing the volatile which will control the local environment.

The term "environment affecting agent" as used herein means a volatile chemical composition which will have a Bio-effect on living organisms, including olefactory or other sense-affecting compositions.

The term "local environment" means the immediate vicinity of the container of the invention.

BRIEF DESCRIPTION OF THE DRAWINGS

FIG. 1 is a view-in-perspective of an embodiment container of the invention.

FIG. 2 is an enlarged view along lines 2—2 of FIG. 1.

FIG. 3 is a view of the opened end of the container shown in FIG. 1, exposing the adhesive composition with which the end was sealed closed.

DETAILED DESCRIPTION OF THE PREFERRED EMBODIMENTS OF THE INVENTION

FIG. 1 is a view-in-perspective of a bag-type of container 10 which comprises a tube of paper, sealed at upper end 12 and lower end 14 with an adhesive composition which adheres a fold 16 or 17 to the underlying body or sidewall 18 of the container 10. The closed container 10 defines on the interior thereof a chamber for the closed containment of a material, for example an odorous material such as pet food, kitty litter or like materials. The bag container 10 as described to this point is a conventional bag, the fabrication of which is well known to those skilled in the art. Where the embodiment container 10 departs from the known art is in the adhesive composition employed to seal at least one of the ends 12, 14.

FIG. 2 is an enlarged view along lines 2—2 of FIG. 1 and shows the structural detail of the fold 16 (double fold) which secures the end 12 in a closed, secure manner. The fragrance containing adhesive composition 20 is sandwiched between the fold 16 and the body 18 of bag 10 so that it is protected from the atmosphere. This limits release of the fragrance until opening of the fold 16 exposes the composition 20 to the atmosphere.

FIG. 3 is a view of the opened end 12 of bag container 10, showing or exposing an applied adhesive composition 20 which was originally applied to close end 12 by openably sealing the fold 16 to body 18 of the container 10. The adhesive composition 20 may be any conventional and known adhesive which will function to close the end 12 of the bag container 10, modified to contain as an essential ingredient a fragrance which will be slowly released from the adhesive composition 20 before exposure and upon exposure of the composition 20 to the atmosphere will be much more rapidly released as shown in FIG. 3.

Representative of adhesive composition 20 which may be employed are those based on starch, modified starch, dextrines, urea-formaldehyde resins, polyvinyl alcohol, polyvinyl acetate, acrylics, clays and proteins.

Fragrances which may be added to the adhesive compositions 20 as described above are represented by natural essential oils such as lemon oil, mandarin oil, clove leaf oil, petitgrain oil, cedar wood oil, patchouli oil, lavandin oil, neroli oil, ylang oil, rose absolute or jasmin absolute; natural resins such as labdanum resin or olibanum resin; single perfumery chemicals which may be isolated from natural sources or manufactured synthetically, as for example alcohols such as geraniol, nerol, citronellol, linalool, tetrahydrogeraniol, beta-phenylethyl alcohol, methyl phenyl carbinol, dimethyl benzyl carbinol, menthol or cedrol; acetates and other esters derived from such alcohols-aldehydes such as citral, citronellal, hydroxycitroneallal, lauric aldehyde, undecylenic aldehyde, cinnamaldehyde, amyl cinnamic aldehyde, vanillin or heliotropin; acetals derived from such aldehydes; ketones such as methyl hexyl ketone, the ionones and the methylionones; phenolic compounds such as eugenol and isoeugenol; synthetic musks such as musk xylene, musk ketone and ethylene brassylate and the like.

The proportion of fragrance in adhesive composition is not critical. The fragrances may comprise from 1 percent to 50 percent by weight of the admixture of fragrance and adhesive composition 20. Addition of the fragrance may be carried out using conventional methods and apparatus, when the adhesive composition is in a liquid state, prior to application to the body 18 of the bag 10. When the liquid application dries, the fragrance is partially locked in, but slowly and sustainably releaseable upon exposure of the composition 20 to the atmosphere when the bag 10 is opened.

The following example shows the manner and process of making and using the invention and sets forth the best mode contemplated by the inventor for carrying out the invention.

EXAMPLE

A plain kraft paper bag is filled with kitty litter and an end sealed closed with an adhesive composition of the following formula:

FRAGRANCED ADHESIVE FORMULA

Step I 27.06 parts modified corn starch
2.70 parts urea formaldehyde resin
0.81 parts sodium chloride
0.27 parts defoamer (self emulsifiable oil)
69.16 parts water The above is thoroughly mixed and cooked to 190° F. The cooked adhesive is cooled with agitation to 120° F.

Step II

Add 10 parts of fragrance oil No. 83439 (Bush Boake Allen, Inc.) to each 100 parts of adhesive from Step I. Mix thoroughly until oil is uniformly dispersed.

Product from Step II is the finished adhesive that is used in bag manufacture.

After a period of from 30 to 360 days, during which time the fragrance is apparent but weak, the seal is broken. A noticeable increase in the fragrance is observed for about 30 days after opening.

Although the above-described preferred embodiment comprises a bag-type container, those skilled in the art will appreciate that the invention may include any type of container, including boxes, multiwall bags, corrugated containers, folding cartons, plastic bags and the like sealed with a fragrance containing adhesive in any position in the container. Also, the seams of the container which are normally not opened to gain access to the contained contents may be adhesively closed with the volatile containing adhesive for sustained, slow release of the volatile to the immediate environment. Also, plies of the container may be adhered to each other with the same adhesive compositions.

Those skilled in the art will also appreciate that volatile compounds other than fragrances may be dispersed in accordance with the invention, such as pesticides insecticide, bacteriocides, fungicides, animal repellants malador counteractants, etc. and the like. As part of the adhesive seam of the container of the invention, such slow release volatiles may protect the container contents from insects, fungus infection, animal intruders etc. which might seek to penetrate the container through a container seam.

What is claimed:

1. In a closed container formed by the adhesive sealing of a component part, the improvement which comprises; said sealing comprising an adhesive composition providing a volatile, sustained release, environment affecting agent; said adhesive composition containing and slowly releasing the volatile agent which will control the environment.

2. A container incorporating a volatile releasing feature which comprises;

a hollow body having first and second closed ends;

said body and said ends together defining a closed chamber adapted by size and configuration to contain materials;

said body being formed by adhesively closed seams;

at least one of said ends being openably sealed closed with an adhesive composition;

said adhesive composition containing and slowly releasing a volatile agent which will control the local environment.

3. A container for non-odorous, built-in latent pleasant odor or obnoxiously odorous materials, which comprises;

a hollow body having first and second closed ends;

said body and said ends together defining a closed chamber adapted by size and configuration to contain said materials.

at least one of said ends being openably sealed closed with an adhesive composition;

said adhesive composition containing a releasable fragrance which will emit a pleasant odor to enhance non odorous materials, simulate the latent odor of the material or mask or counteract the odor of the material;

said fragrance being continuously released from the adhesive composition to the atmosphere.

4. The container of claim 3 which is a paper bag.

* * * * *